US009376892B2

(12) United States Patent
Fripp et al.

(10) Patent No.: US 9,376,892 B2
(45) Date of Patent: Jun. 28, 2016

(54) MAGNETIC VALVE ASSEMBLY

(71) Applicant: Halliburton Energy Services, Inc., Houston, TX (US)

(72) Inventors: Michael L. Fripp, Carrollton, TX (US); Luke William Holderman, Richardson, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/710,263

(22) Filed: May 12, 2015

(65) Prior Publication Data

US 2015/0240600 A1 Aug. 27, 2015

Related U.S. Application Data

(62) Division of application No. 14/130,632, filed as application No. PCT/US2013/023687 on Jan. 29, 2013, now Pat. No. 9,062,516.

(51) Int. Cl.

| | |
|---|---|
| ***E21B 34/06*** | (2006.01) |
| ***E21B 34/16*** | (2006.01) |
| ***E21B 34/08*** | (2006.01) |
| ***E21B 34/14*** | (2006.01) |
| *E21B 34/00* | (2006.01) |

(52) U.S. Cl.

CPC ..... *E21B 34/16* (2013.01); *E21B 34/06* (2013.01); *E21B 34/066* (2013.01); *E21B 34/08* (2013.01); *E21B 34/14* (2013.01); *E21B 2034/002* (2013.01)

(58) Field of Classification Search

USPC ..... 166/373, 318, 325, 329, 332.4; 175/4.54, 4.56, 55.1

See application file for complete search history.

(56) References Cited

U.S. PATENT DOCUMENTS

| | | | | |
|---|---|---|---|---|
| 3,086,589 | A * | 4/1963 | McGowen, Jr. | E21B 33/12 166/134 |
| 3,105,551 | A * | 10/1963 | Ehlert | E21B 41/00 166/63 |
| 4,020,902 | A | 5/1977 | Valdespino | |
| 6,032,734 | A * | 3/2000 | Telfer | E21B 23/00 166/106 |
| 6,988,556 | B2 | 1/2006 | Vick, Jr. | |
| 7,370,709 | B2 | 5/2008 | Williamson, Jr. | |
| 7,631,699 | B2 * | 12/2009 | Cisneros | E21B 23/04 166/208 |
| 2007/0272411 | A1 | 11/2007 | Lopez De Cardenas et al. | |
| 2008/0135249 | A1 | 6/2008 | Fripp et al. | |
| 2008/0157014 | A1 | 7/2008 | Vick, Jr. et al. | |
| 2009/0071654 | A1 | 3/2009 | O'Malley et al. | |
| 2009/0101341 | A1 | 4/2009 | Willauer | |
| 2009/0272580 | A1 | 11/2009 | Dolman et al. | |
| 2011/0056677 | A1 | 3/2011 | Holderman | |

(Continued)

OTHER PUBLICATIONS

International Search Report issued in Related PCT Application No. PCT/US2013/023687 mailed Oct. 10, 2013, 4 pages.

*Primary Examiner* — David Bagnell
*Assistant Examiner* — Ronald Runyan
(74) *Attorney, Agent, or Firm* — Scott Richardson; Baker Botts L.L.P.

(57) ABSTRACT

An actuation device comprises a housing comprising one or more ports, a magnetic valve component, and a central flowbore. The central flowbore is configured to receive a disposable member configured to emit a magnetic field, and the magnetic valve component is configured to radially shift from a first position to a second position in response to interacting with the magnetic field.

10 Claims, 11 Drawing Sheets

(56) References Cited

U.S. PATENT DOCUMENTS

| | | | |
|---|---|---|---|
| 2011/0056692 | A1 | 3/2011 | Lopez De Cardenas et al. |
| 2011/0073308 | A1 | 3/2011 | Assal et al. |
| 2011/0174484 | A1 | 7/2011 | Wright et al. |
| 2011/0186300 | A1 | 8/2011 | Dykstra et al. |
| 2011/0214876 | A1 | 9/2011 | Dykstra et al. |
| 2011/0265987 | A1 | 11/2011 | Wright et al. |
| 2011/0266001 | A1 | 11/2011 | Dykstra et al. |
| 2011/0284240 | A1 | 11/2011 | Chen et al. |
| 2011/0297384 | A1 | 12/2011 | Fripp et al. |
| 2011/0297385 | A1 | 12/2011 | Dykstra et al. |
| 2011/0308806 | A9 | 12/2011 | Dykstra et al. |
| 2012/0061102 | A1 | 3/2012 | Holderman et al. |
| 2012/0118582 | A1 | 5/2012 | Soni et al. |
| 2012/0160478 | A1 | 6/2012 | Todd et al. |
| 2012/0181037 | A1 | 7/2012 | Holderman |
| 2012/0241143 | A1 | 9/2012 | Wright et al. |
| 2012/0255739 | A1 | 10/2012 | Fripp et al. |
| 2012/0255740 | A1 | 10/2012 | Fripp et al. |
| 2013/0014941 | A1 | 1/2013 | Tips et al. |
| 2013/0014959 | A1 | 1/2013 | Tips et al. |
| 2013/0037276 | A1 | 2/2013 | Kuo et al. |
| 2013/0048290 | A1 | 2/2013 | Howell et al. |
| 2013/0056217 | A1 | 3/2013 | Dykstra et al. |
| 2013/0092393 | A1 | 4/2013 | Dykstra et al. |
| 2013/0112423 | A1 | 5/2013 | Dykstra et al. |
| 2013/0140038 | A1 | 6/2013 | Fripp et al. |
| 2013/0153238 | A1 | 6/2013 | Fripp et al. |
| 2013/0180727 | A1 | 7/2013 | Dykstra et al. |
| 2013/0192833 | A1 | 8/2013 | Gano et al. |
| 2013/0220632 | A1 | 8/2013 | Greci et al. |
| 2013/0222148 | A1 | 8/2013 | Gano et al. |
| 2013/0228341 | A1 | 9/2013 | Fripp et al. |
| 2013/0264051 | A1 | 10/2013 | Kyle et al. |
| 2013/0264072 | A1 | 10/2013 | Lopez et al. |
| 2013/0269950 | A1 | 10/2013 | Fripp et al. |
| 2013/0276901 | A1 | 10/2013 | Holderman |
| 2013/0277059 | A1 | 10/2013 | Holderman et al. |
| 2013/0292123 | A1 | 11/2013 | Murphree et al. |
| 2013/0299198 | A1 | 11/2013 | Gano et al. |
| 2013/0327540 | A1 | 12/2013 | Hamid et al. |
| 2013/0328316 | A1 | 12/2013 | Rodney et al. |
| 2013/0333890 | A1 | 12/2013 | Dagenais et al. |
| 2014/0000869 | A1 | 1/2014 | Holderman et al. |
| 2014/0020898 | A1 | 1/2014 | Holderman et al. |
| 2014/0027104 | A1 | 1/2014 | Holderman et al. |
| 2014/0041731 | A1 | 2/2014 | Fripp et al. |
| 2014/0048279 | A1 | 2/2014 | Holderman |
| 2014/0048280 | A9 | 2/2014 | Fripp et al. |
| 2014/0048282 | A1 | 2/2014 | Dykstra et al. |
| 2014/0090857 | A1 | 4/2014 | Fripp et al. |
| 2014/0110123 | A1 | 4/2014 | Murphree et al. |
| 2014/0110128 | A1 | 4/2014 | Dykstra et al. |
| 2014/0209823 | A1 | 7/2014 | Fripp et al. |

* cited by examiner

MAGNETIC VALVE ASSEMBLY

BACKGROUND

When wellbores are prepared for oil and gas production, it is common to cement a casing string within the wellbore. Often, it may be desirable to cement the casing string within the wellbore in multiple, separate stages. The casing string may be run into the wellbore to a predetermined depth. Various "zones" in the subterranean formation may be isolated via the operation of one or more packers, which may also help to secure the casing string and stimulation equipment in place, and/or via cement.

Following the placement of the casing string, it may be desirable to provide at least one route of fluid communication out of the casing string. Where fluids are produced from a long interval of a formation penetrated by a wellbore, it is known that balancing the production of fluid along the interval can lead to reduced water and gas coning, and more controlled conformance, thereby increasing the proportion and overall quantity of oil or other desired fluid produced from the interval. Various devices and completion assemblies have been used to help balance the production of fluid from an interval in the wellbore. For example, inflow control devices have been used in conjunction with well screens to restrict the flow of produced fluids through the screens for the purposes of balancing production along an interval.

Conventionally, the methods and/or tools employed to provide fluid pathways within a casing string require mechanical tools supplied by a rig and/or downhole tools needing high temperature protection, long term batteries, and/or wired surface connections. Additionally, conventional methods may not allow for individual, or at least selective, activation of a route of fluid communication from a plurality of formation zones. As such, there exists a need for devices, systems, and/or methods for allowing and/or configuring fluid pathways within a casing string while being capable of withstanding wellbore conditions for the lifetime of a wellbore servicing operation.

SUMMARY

In an embodiment, an actuation device comprises a housing comprising one or more ports, a magnetic valve component, and a central flowbore. The central flowbore is configured to receive a disposable member configured to emit a magnetic field, and the magnetic valve component is configured to radially shift from a first position to a second position in response to interacting with the magnetic field.

In an embodiment, an actuation system for a downhole component comprises a wellbore tubular comprising a central flowbore and a magnetic valve seat, where the magnetic valve seat is disposed about the wellbore tubular, and a plug comprising at least one magnet. The plug is configured to be received within the central flowbore, and the at least one magnet is configured to axially shift the magnetic valve seat from a first position to a second position when the plug passes within the central flowbore.

In an embodiment, a method of actuating a magnetic valve in a wellbore comprises preventing, by a magnetic valve component disposed about a wellbore tubular, fluid flow through a fluid pathway in a wellbore assembly in a first direction, passing a magnetic member through a central flowbore of the wellbore assembly; wherein the disposable member comprises a magnetic field, transitioning at least one magnetic valve component from a first position to a second position in response to the magnetic field of the magnetic member, and allowing fluid flow through the fluid pathway in the first direction in response to the transitioning of the at least one magnetic valve component. The fluid pathway is configured to provide fluid communication between an exterior of a wellbore assembly and an interior of the wellbore assembly.

These and other features will be more clearly understood from the following detailed description taken in conjunction with the accompanying drawings and claims.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
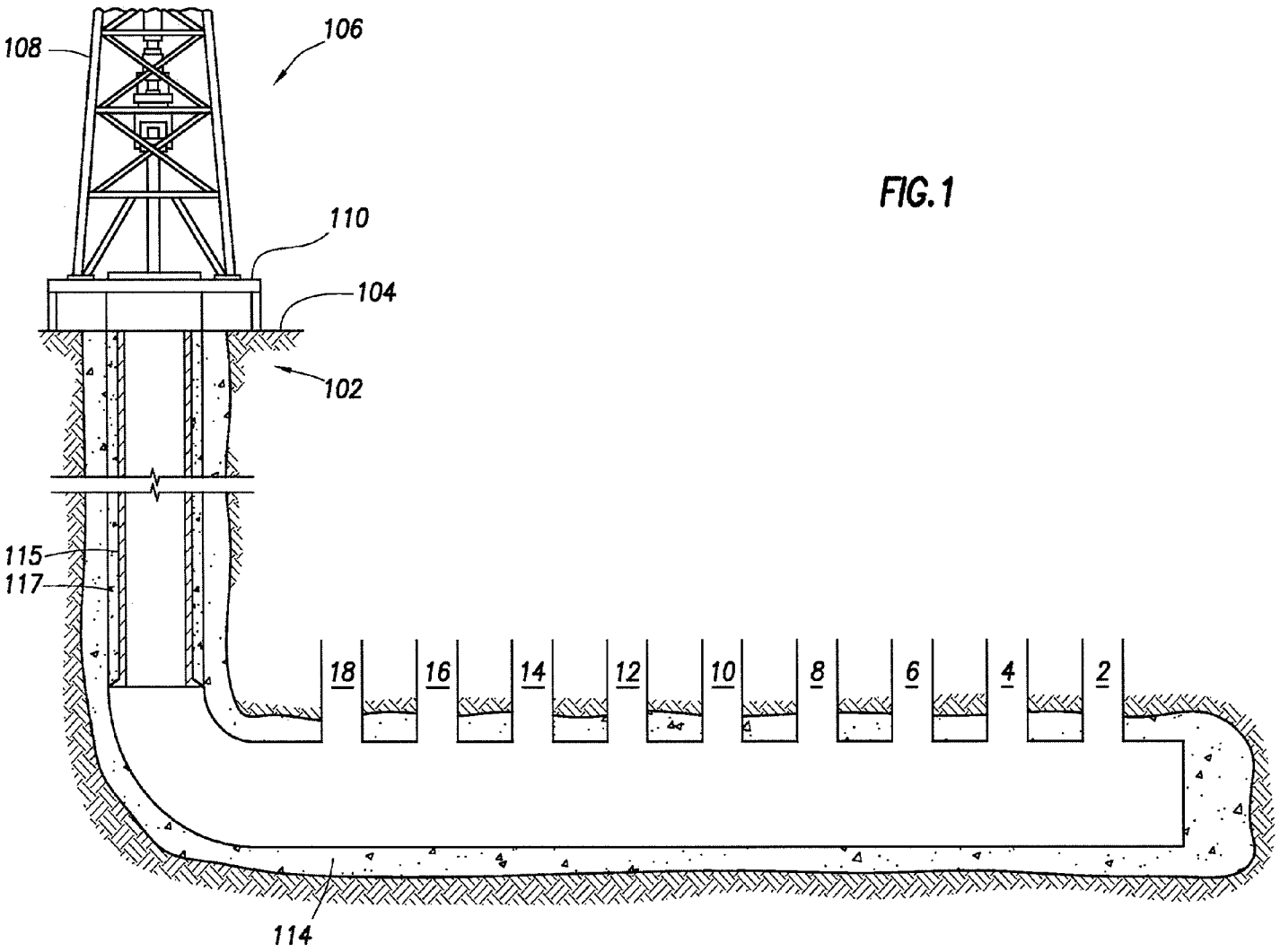
FIG. 1 is a partial cut-away of an embodiment of an environment in which a magnetic valve assembly and method of use of using such magnetic valve assembly may be employed.

In the drawings and description that follow, like parts are typically marked throughout the specification and drawings with the same reference numerals, respectively. In addition, similar reference numerals may refer to similar components in different embodiments disclosed herein. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is not intended to limit the invention to the embodiments illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described. Unless otherwise specified, use of the terms "up," "upper," "upward," "up-hole," or other like terms shall be construed as generally from the formation toward the surface or toward the surface of a body of water; likewise, use of "down," "lower," "downward," "down-hole," or other like terms shall be construed as generally into the formation away from the surface or away from the surface of a body of water, regardless of the wellbore orientation. Use of any one or more of the foregoing terms shall not be construed as denoting positions along a perfectly vertical axis. Unless otherwise specified, use of the term "subterranean formation" shall be construed as encompassing both areas below exposed earth and areas below earth covered by water such as ocean or fresh water.

Various devices and completion assemblies have been used to help balance the production of fluid from an interval in the wellbore. For example, various flow control devices can be used to balance the production along one or more intervals by adjusting the resistance to flow at various points along the wellbore. The resistance to flow can be adjusted at various points of the life of the wellbore to allow one or more additional procedures to be performed and/or to adjust for changes in the reservoir properties. For example, the production or completion assemblies may be disposed in a wellbore in a closed configuration to allow for pressure testing and/or the development of pressure within the completion assembly to operate various tools. Once the desired operations are complete, the completion or production assemblies may be selectively actuated to the desired production positions. At various subsequent times, the assemblies may be selectively closed, opened, and/or shifted to new positions as desired.

In general, completion assemblies can be actuated using physical interventions in the wellbore, such as tools coupled to a wireless or a slickline. Such operations require time to transition the tools within the wellbore and remove the tool after actuating one or more of the assemblies. Rather than relying on physical interventions, the system disclosed herein may generally rely on a pumped component such as a dart or ball to selectively actuate one or more assemblies from a first position to a second position. In order to utilize a pumped component, a magnetic valve assembly (MVA) as disclosed herein may be used to selectively actuate one or more downhole components. In an embodiment, the MVA may allow an operator to wirelessly open and/or close one or more valves, such as for production of one or more zones of a subterranean formation and to produce a formation fluid therefrom.

In general, the MVA comprises a downhole component having a magnetic valve component. The magnetic valve component is configured to radially shift in response to a magnetic field and/or, longitudinally translate to open a flow path. A disposable magnetic member in the form of a pumped component may be disposed in the wellbore. The disposable magnetic member can be configured to produce a magnetic field, which may interact with the magnetic valve component to shift the magnetic valve component based on the interaction of the magnetic fields. For example, a magnetic valve component may be radially shifted inwards or outwards. In some embodiments, the magnetic valve component may be axial shifted by being pulled or pushed by a magnetic field from the disposable magnetic member. The disposable magnetic member may pass through the wellbore and actuate one or more magnetic valve components. The magnetic valves may act as one-way valves or two-way valves.

Using the magnetic valve components having a plurality of positions may allow the configuration of a flow path between the wellbore tubular interior and the wellbore tubular exterior to be selectively controlled. For example, a flow path through a production sleeve may be transitioned from a closed position to an open position in response to the magnetic field from the disposable magnetic member. In some embodiments, the flow path may pass through a restriction, thereby controlling the resistance to flow. Further, a wellbore tubular string comprising a plurality of MVAs may be selectively actuated using a single disposable magnetic member. A second disposable magnetic member may be used to revert one or more of the magnetic valve components to a previous position using a magnetic field with a different polarity.

Additionally, the actuation devices as disclosed herein, may allow for selective actuation of a plurality of zones without the need to maintain a casing string pressure to actuate one or more valves. For example, as will be appreciated by one of ordinary skill in the art upon viewing this disclosure, whereas conventional actuation devices utilize a pressure within at least a portion of a casing string to apply a force (e.g., so as to actuate valve), the actuation device disclosed herein may be actuated without the need to establish and/or to maintain any such pressure, thereby allowing selective valve actuation independent of previous valve actuations. As such, the presently disclosed actuation device may provide an operator with improved control and flexibility for scheduling the actuation of various valves while offering improved reliability.

Referring to FIG. 1, in an embodiment of an operating environment in which such a MVA and/or method may be employed is illustrated. It is noted that although some of the figures may exemplify horizontal or vertical wellbores, the principles of the methods, apparatuses, and systems disclosed herein may be similarly applicable to horizontal wellbore configurations, conventional vertical wellbore configurations, or combinations thereof. Therefore, unless otherwise noted, the horizontal, deviated, or vertical nature of any figure is not to be construed as limiting the wellbore to any particular configuration.

Referring to the embodiment of FIG. 1, the operating environment generally comprises a wellbore 114 that penetrates a subterranean formation 102. Additionally, in an embodiment, the subterranean formation 102 may comprise a plurality of formation zones 2, 4, 6, 8, 10, 12, 14, 16, and 18 for the purpose of recovering hydrocarbons, storing hydrocarbons, disposing of carbon dioxide, or the like. The wellbore 114 may be drilled into the subterranean formation 102 using any suitable drilling technique. In an embodiment, a drilling, completion, or servicing rig 106 comprises a derrick 108 with a rig floor 110 through which one or more tubular strings (e.g., a work string, a drill string, a tool string, a segmented tubing string, a jointed tubing string, or any other suitable conveyance, or combinations thereof) generally defining an axial flowbore may be positioned within or partially within the wellbore 114. In an embodiment, such a tubular string may comprise two or more concentrically positioned strings of pipe or tubing (e.g., a first work string may be positioned within a second work string). The drilling or servicing rig 106 may be conventional and may comprise a motor driven winch and other associated equipment for conveying the work string with the wellbore 114. Alternatively, a mobile workover rig, a wellbore servicing unit (e.g., coiled tubing units), or the like may be used to convey the tubular string within the wellbore 114. In such an embodiment, the tubular string may be utilized in drilling, stimulating, completing, or otherwise servicing the wellbore, or combinations thereof.

The wellbore 114 may extend substantially vertically away from the earth's surface 104 over a vertical wellbore portion, or may deviate at any angle from the earth's surface 104 over a deviated or horizontal wellbore portion. In alternative operating environments, portions or substantially all of the wellbore 114 may be vertical, deviated, horizontal, and/or curved. In an embodiment, the wellbore 114 may be a new hole or an existing hole and may comprise an open hole, cased hole, cemented cased hole, pre-perforated lined hole, or any other suitable configuration, or combinations thereof. For example, in the embodiment of FIG. 1, a casing string 115 is positioned within at least a portion of the wellbore 114 and is secured into position with respect to the wellbore with cement 117 (e.g., a cement sheath). In alternative embodiments, portions and/or substantially all of such a wellbore may be cased and cemented, cased and uncemented, uncased, or combinations thereof. In another alternative embodiment, a casing string may be secured against the formation utilizing one or more suitable packers, such as mechanical packers or swellable packers (for example, SwellPackers™, commercially available from Halliburton Energy Services).

Figure 2:
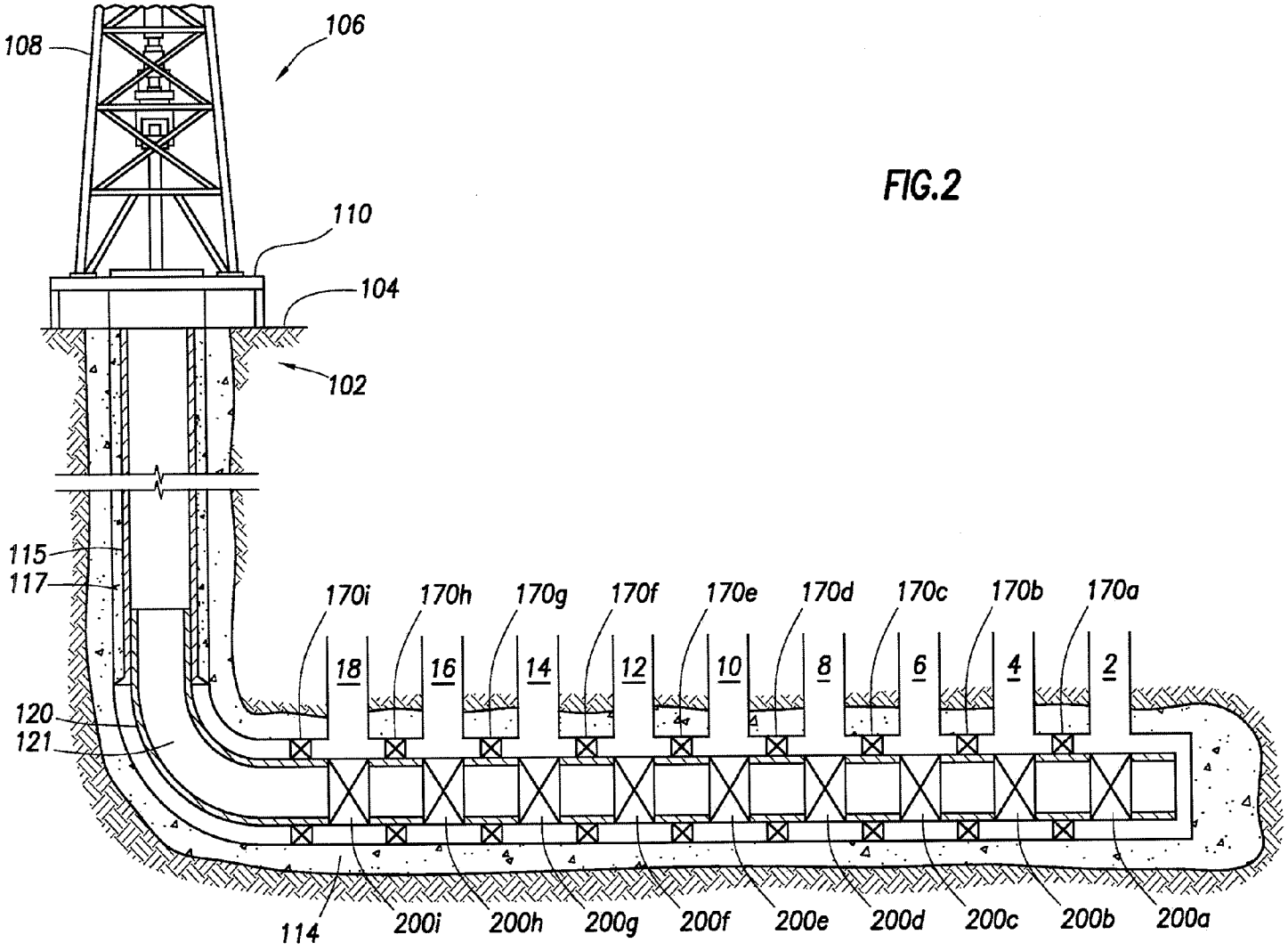
FIG. 2 is a partial cut-away view of an embodiment of a wellbore penetrating a subterranean formation, the wellbore having a magnetic valve assembly positioned therein.

In an embodiment as illustrated in FIG. 2, one or more MVA 200 may be disposed within the wellbore 114. In such an embodiment, the wellbore tubular string 120 may comprise any suitable type and/or configuration of string, for example, as will be appreciated by one of ordinary skill in the art upon viewing this disclosure. In an embodiment, the wellbore tubular string 120 may comprise one or more tubular members (e.g., jointed pipe, coiled tubing, drill pipe, etc.). In an embodiment, each of the tubular members may comprise a suitable means of connection, for example, to other tubular members and/or to one or more MVA 200, as will be disclosed herein. For example, in an embodiment, the terminal ends of the tubular members may comprise one or more internally or externally threaded surfaces, as may be suitably employed in making a threaded connection to other tubular members and/or to one or more MVA 200. In an embodiment, the wellbore tubular string 120 may comprise a tubular string, a liner, a production string, a completion string, another suitable type of string, or combinations thereof.

Figure 3A:
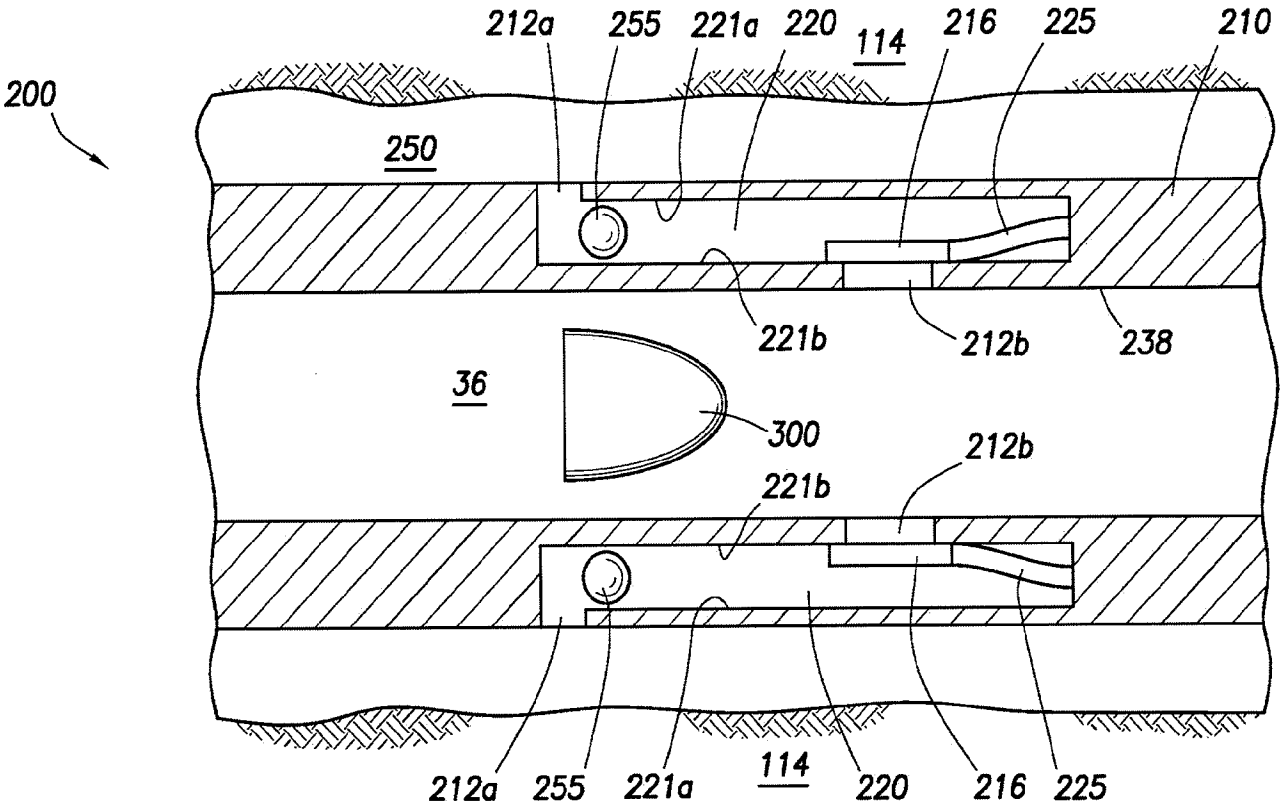
FIG. 3A is a cross-sectional view of an embodiment of a magnetic valve assembly in a first configuration.
Figure 3B:
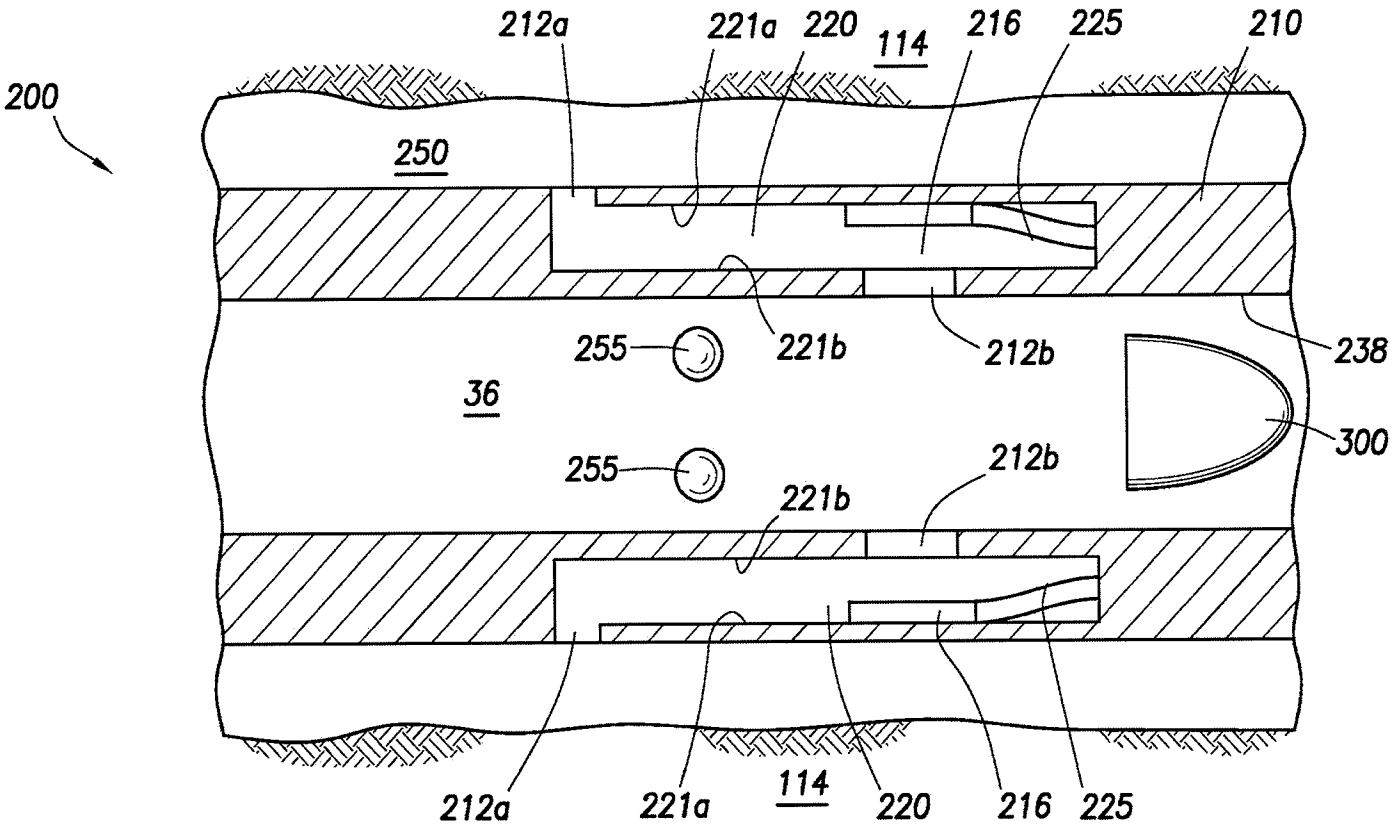
FIG. 3B is a cross-sectional view of an embodiment of a magnetic valve assembly in a second configuration.

In an embodiment, the MVA 200 may be configured so as to selectively configure a route of fluid communication therethrough, for example, in response to experiencing a magnetic field. Referring to FIGS. 3A-3B, an embodiment of such a MVA 200 is disclosed herein. In the embodiment of FIGS. 3A-3B, the MVA 200 may generally comprise a housing 210 generally defining a flow passage 36, one or more magnetic valves 216, and one or more ports (e.g., an outer port and an inner port, 212*a* and 212*b*, respectively; cumulatively and non-specifically, ports 212) for communication a fluid between the flow passage 36 of the MVA 200 and an exterior 250 of the MVA 200 (e.g., an annular space).

In an embodiment, the MVA 200 is selectively configurable either to allow fluid communication to/from the flow passage 36 of the MVA 200 to/from the exterior 250 of the MVA 200 or to disallow fluid communication to/from the flow passage 36 of the MVA 200 to/from the exterior 250 of the MVA 200. Additionally or alternatively, in an embodiment, the MVA 200 may be configured to selectively control fluid inflow rate to/from the flow passage 36 of the MVA 200 to/from the exterior 250 of the MVA 200, as will be disclosed herein. In an embodiment, for example, as illustrated in FIGS. 3A-3B, the MVA 200 may be configured to be transitioned from a first configuration to a second configuration, as will be disclosed herein.

Figure 4A:
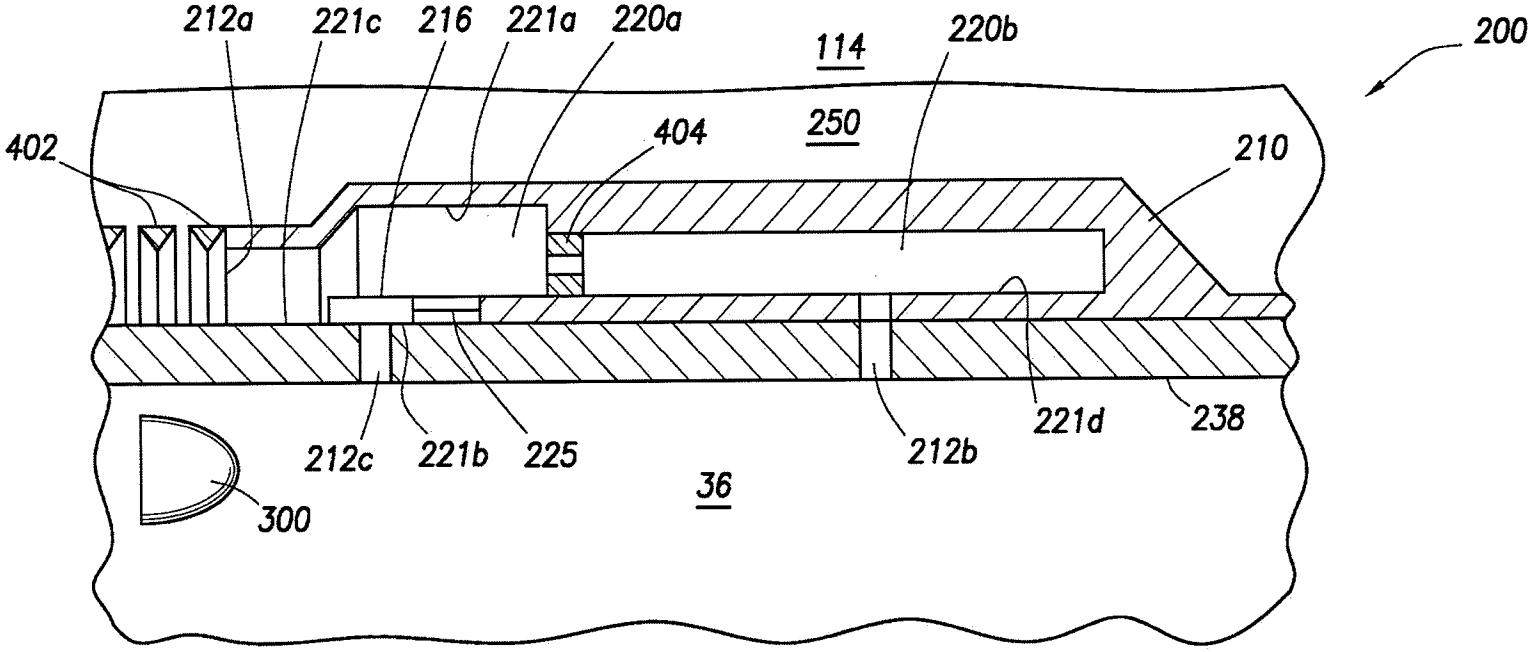
FIG. 4A is a cross-sectional view of an embodiment of a magnetic valve assembly comprising an inflow control device in a first configuration.

In the embodiments of FIG. 3A and FIG. 4A, the MVA 200 is illustrated in the first configuration. In the embodiment of FIG. 3A, in the first configuration, the MVA 200 is configured to disallow a route of fluid communication in the direction from the exterior 250 of the MVA 200 to the flow passage 36 of the MVA 200. In an additional embodiment, in the first configuration, the MVA 200 is further configured to disallow a route of fluid communication in the direction from the flow passage 36 of the MVA 200 to the exterior 250 of the MVA 200. In an alternative embodiment, as illustrated in FIG. 4A, in the first configuration, the MVA 200 is configured to allow a route of fluid communication via first flow path (e.g., through an inflow control device), as will be disclosed herein.

Figure 4B:
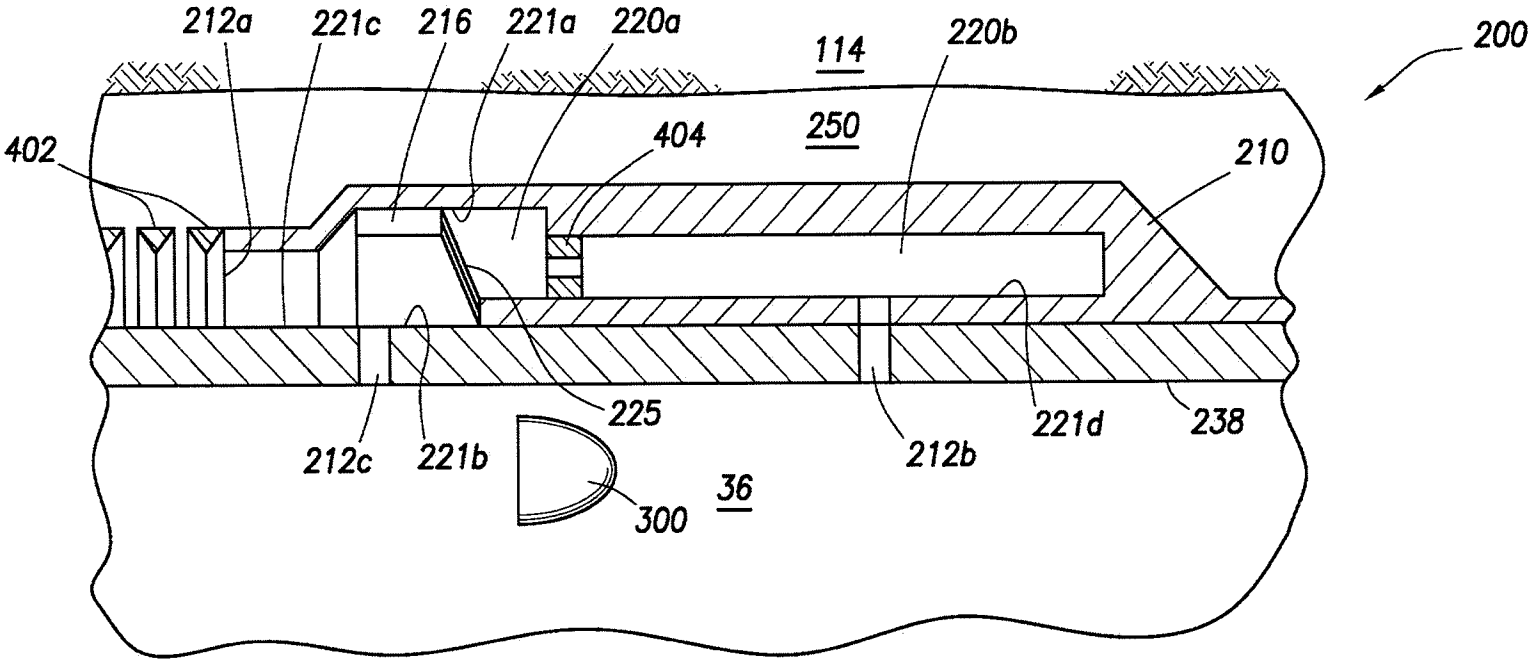
FIG. 4B is a cross-sectional view of an embodiment of a magnetic valve assembly comprising an inflow control device in a second configuration.

In the embodiment of FIG. 3B and FIG. 4B, the MVA 200 is illustrated in the second configuration. In the embodiment of FIG. 3B, in the second configuration, the MVA 200 is configured to allow fluid communication between the flow passage 36 of the MVA 200 and the wellbore 114 via the ports 212. In an alternative embodiment, as illustrated in FIG. 4B, in an embodiment, in the second configuration, the MVA 200 is configured to allow a route of communication via second flow path (e.g., a bypass port), as will be disclosed herein. In an embodiment, the MVA 200 may be configured to transition from the first configuration to the second configuration upon experiencing a magnetic field or signal within the flow passage 36 of the MVA 200, as will be disclosed herein.

Referring to FIGS. 3A-3B and FIGS. 4A-4B, in an embodiment, the housing 210 may generally comprise a cylindrical or tubular-like structure. The housing 210 may comprise a unitary structure; alternatively, the housing 210 may be made up of two or more operably connected components (e.g., an upper component and a lower component). Alternatively, the housing 210 may comprise any suitable structure as would be appreciated by one of ordinary skill in the art upon viewing this disclosure. In an embodiment, the housing 210 may be made of a ferromagnetic material (e.g., a material susceptible to a magnetic field), such as, iron, cobalt, nickel, steel, rare-earth metal alloys, any other suitable material as would be appreciated by one of ordinary skill in the art upon viewing this disclosure, or combination thereof. Additionally, in an embodiment, an inner bore surface 238 of the housing 210 may not be susceptible to a magnetic field (e.g., not made of a ferromagnetic material). In an additional or alternative embodiment, the housing 210 may further comprise one or more windows comprising non-ferromagnetic material disposed about the interior bore surface 238 of the housing 210, for example, positioned substantially adjacent to and/or in-line with a valve and the flow passage 36, as will be disclosed herein.

In an embodiment, the MVA 200 may be configured for incorporation into the wellbore tubular string 120 and/or another suitable tubular string. In such an embodiment, the housing 210 may comprise a suitable connection to the wellbore tubular string 120 (e.g., to a casing string member, such as a casing joint), or alternatively, into any suitable string (e.g., a liner, a work string, a coiled tubing string, etc.). For example, the housing 210 may comprise internally or externally threaded surfaces and may be configured to be joined with the casing string 120 via the internally or externally threaded surfaces. Additional or alternative suitable connections to a casing string (e.g., a tubular string) will be known to those of ordinary skill in the art upon viewing this disclosure.

In the embodiment of FIGS. 3A-3B and 4A-4B, the housing 210 generally defines the flow passage 36, for example, the flow passage 36 may be generally defined by the inner bore surface 238 of the housing 210. In such an embodiment, the MVA 200 is incorporated within the wellbore tubular string 120 such that the flow passage 36 of the MVA 200 is in fluid communication with the flow passage 121 of the wellbore tubular string 120.

Additionally, in an embodiment, the housing 210 may further comprise one or more recesses, cut-outs, chambers, voids, or the like, as will be disclosed herein. For example, in an embodiment as illustrated in FIGS. 3A-3B, the housing 210 may comprise a one or more ported chambers 220 and may be disposed circumferentially around the flow passage 36 of the MVA 200.

In an embodiment, the housing 210 comprises one or more ports 212. In an embodiment, the one or more ports 212 may be disposed circumferentially around an interior and/or exterior surface of the housing 210, as will be disclosed herein. As such, the ports 212 may provide a route of fluid communication between the flow passage 36 and the exterior 250 of the MVA 200, when so-configured. For example, in an embodiment as illustrated in FIGS. 3A-3B, the ports 212 may comprise the outer port 212*a* and the inner port 212*b*. In an embodiment, the outer port 212*a* may extend radially between the ported chamber 220 and exterior 250 of the MVA 200. Additionally, the inner port 212*b* may extend radially between the flow passage 36 and the ported chamber 220. For example, in an embodiment, the MVA 200 may be configured such that the ports 212 (e.g., the outer port 212*a* and the inner port 212*b*) provide a route of fluid communication between the flow passage 36 and the exterior 250 of the MVA 200 (e.g., via a ported chamber) when the ports 212 are unblocked. Alternatively, the MVA 200 may be configured such that no fluid will be communicated via one or more of the ports 212 between the flow passage 36 and the exterior 250 of the MVA 200 when the route of fluid communication of the ports 212 are blocked (e.g., by the magnetic valve 216 or a check valve, as will be disclosed herein).

In an embodiment, for example as illustrated in FIGS. 3A-3B, the ports 212 (e.g., the outer port 212*a* and the inner port 212*b*) may be configured to comprise different diameters. For example, in an embodiment, the diameter of the inner port 212*b* may be generally characterized as being greater than the diameter of the outer port 212*a*. In an alternative embodiment, the outer port 212*a* and the inner port 212*b* may be configured to have about the same diameter. Additionally, the ports 212 (e.g., the inner port 212*b*) may be sufficiently sized so that a magnetic field may penetrate the ports 212. For example, in an embodiment, the ports 212 may be sized such that a magnetic field within the flow passage 36 of the MVA 200 may interact with one or more magnetic devices (e.g., a magnetic valve) via the ports 212. Alternatively, in an embodiment, one or more non-ferromagnetic windows may be disposed adjacent to or about the ports 212 to allow a magnetic field to interact with a valve, as will be disclosed herein.

In an embodiment, as illustrated in FIGS. 3A-3B, the outer port 212*a* may be disposed along an outer chamber surface 221*a* of the ported chamber 220 and the outer port 212*a* may provide a route of fluid communication between the exterior 250 of the housing 210 and the ported chamber 220. Additionally, in an embodiment, the inner port 212*b* may be disposed along the inner chamber surface 221*b* of the ported chamber 220 and may provide a route of fluid communication between the ported chamber 220 and the flow path 36 of the MVA 200. In an embodiment, the outer port 212*a* may be substantially aligned, at least partially up-hole, or at least partially down-hole from the inner port 212*b*.

In an alternative embodiment, as illustrated in FIGS. 4A-4B, the housing 210 may comprise the outer port 212*a*, the inner port 212*b*, and a bypass port 212*c*. In such an embodiment, the outer port 212*a* may provide a route of fluid communication between the exterior 250 of the MVA 200 and one or more chambers (e.g., a first ported chamber 220*a* and a second ported chamber 220*b*) within the MVA 200, as will be disclosed herein. Additionally, the inner port 212*b* may be disposed along a second inner chamber surface 221*d* of the second ported chamber 220*b* and may provide a route of fluid communication between the second ported chamber 220*b* and the flow path 36 of the MVA 200. Further, the bypass port 212*c* may be disposed along a first inner chamber surface 221*c* of the first ported chamber 220*a* of the housing 210 and may provide a route of fluid communication between the first ported chamber 220*a* and the flow path 36 of the MVA 200.

Additionally, in an embodiment, one or more of the ports 212 (e.g., the outer port 212*a*) may be positioned adjacent to, at least partially covered by, and/or in fluid communication with a filter element such as a plug, a screen, a filter, a "wire-wrapped" filter, a sintered mesh filter, a pre-pack filter, an expandable filter, a slotted filter, a perforated filter, a cover, or a shield, for example, to prevent debris from entering the ports 212. For example, in the embodiment of FIGS. 4A-4B, the MVA 200 may further comprise a filter 402 (e.g., a "wire-wrapped" filter) positioned adjacent to and/or covering the outer port 212*a*, and the filter 402 may be configured to allow a fluid to pass but not sand or other debris larger than a certain size. In an additional or alternative embodiment, the ports 212 may comprise one or more pressure-altering devices (e.g., nozzles, erodible nozzles, fluid jets, or the like). For example, in such an embodiment, the ports 212 may be configured to provide an adjustable fluid flow rate.

Referring to FIGS. 4A-4B, in an embodiment a flow restrictor 404 may be disposed within the housing 210 to provide a desired resistance to flow (e.g., pressure drop) along a route of fluid communication between the first ported chamber 220*a* and the second ported chamber 220*b*. In such an embodiment, the flow restrictor 404 may be configured to cause a fluid pressure differential across the flow restrictor 404 in response to communicating a fluid through the flow restrictor 404 in at least one direction. In an embodiment, the flow restrictor 404 may be cylindrical in shape and may comprise at least one fluid passage extending axially through the flow restrictor 404 having a diameter significantly smaller than the length of the passage. In an additional or alternative embodiment, the flow restrictor 404 may be formed of an orifice restrictor, a nozzle restrictor, a helical restrictor, a u-bend restrictor, and/or any other types of suitable restrictors for creating a pressure differential across the flow restrictor 404 as would be appreciated by one of ordinary skill in the art upon viewing this disclosure. In some embodiments, the flow restrictor 404 may permit one-way fluid communication, for example, allowing fluid communication in a first direction with minimal resistance and substantially preventing fluid communication in a second direction (e.g., providing a high resistance). For example, in an embodiment, the flow restrictor 404 may comprise a check-valve or other similar device for providing one-way fluid communication.

Additionally, in an embodiment, the route of fluid communication provided by the flow restrictor 404 may be at least partially more restrictive (e.g., providing more resistance)

than the route of fluid communication provided via the bypass port 212*c*. For example, in an embodiment, the flow restrictor 404 may be configured such that a fluid may flow at a lower flow rate and/or a higher pressure drop through the flow restrictor 404 than through the bypass port 212*c*.

Referring to FIGS. 3A-3B and 6A-6B, in an embodiment, the MVA 200 may further comprise a check valve ball 255 disposed within the housing 210, for example, within the ported chamber 220. In an embodiment, the check valve ball 255 may be made of non-ferromagnetic materials. In the embodiments of FIGS. 3A-3B and 6A-6B, the check valve ball 255 may be configured to restrict or substantially restrict fluid communication in one direction, for example, from the ported chamber 220 and/or flow passage 36 to the exterior 250 of the MVA 200 via the outer port 212*a*. Additionally, the check valve ball 255 may be sized such that it may engage and/or block a first port (e.g., the outer port 212*a*) and may pass through a second port (e.g., the inner port 212*b*), as will be disclosed herein.

In the embodiments of FIGS. 3A-3B, 4A-4B, 5A-5B, 6A-6B, 7A-7B, and 8A-8B, the magnetic valve 216 may be configured to selectively allow or disallow a route of fluid communication and/or to selectively control a route of fluid communication via two or more flow paths, as will be disclosed herein. For example, in the embodiments of FIGS. 3A-3B, 5A-5B, 6A-6B, 7A-7B, and 8A-8B, the magnetic valve 216 may be configured to allow or disallow a route of fluid communication between the exterior 250 of the housing 210 and the flow path 36 of the housing 210, as will be disclosed. In an alternative embodiment, as illustrated in FIGS. 4A-4B, the magnetic valve 216 may be configured to selectively control fluid communication between two or more flow paths, as will be disclosed herein.

In an embodiment, the magnetic valve 216 generally comprises a structure sized to be fitted onto or against a corresponding bore (e.g., one or more ports 212). In such an embodiment, the magnetic valve 216 may be positioned to cover one or more ports 212 and may provide a fluid-tight or substantially fluid-tight seal disallowing fluid communication via the one or more ports 212 in at least one direction. For example, in an embodiment, the magnetic valve 216 may be configured to prohibit or substantially restrict fluid communication from the exterior 250 of the housing 210 to the flow passage 36 of the MVA 200.

In the embodiments of FIGS. 3A-3B, 4A-4B, 5A-5B, 7A-7B, and 8A-8B, the magnetic valve 216 may comprise a unitary structure. Alternatively, in the embodiment of FIGS. 6A-6B, the magnetic valve 216 may be made up of two or more operably connected segments (e.g., a first segment, a second segment, etc.). For example, in the embodiment of FIG. 6A-6B, the magnetic valve 216 comprises a fixed segment 216*a* and a sliding segment 216*b* fitted against at least a portion of the inner chamber surface 221*b*. In such an embodiment, the sliding segment 216*b* may be moveable from a first position to a second position and/or slidably fitted against the outer chamber surface 221*a* and/or the inner chamber surface 221*b*, as will be disclosed herein. Additionally, in an embodiment, the magnetic valve 216 may be configured to comprise a check valve ball seat, for example, for the purpose of retaining a check valve ball 255 in a fixed position with respect to the housing 210, as illustrated in FIG. 6A. Alternatively, in an embodiment, the magnetic valve 216 may comprise any suitable structure and/or configurations as would be appreciated by one of ordinary skill in the art upon viewing of this disclosure.

In an embodiment, the magnetic valve 216 may be made of a ferromagnetic material (e.g., a material susceptible to a magnetic field), such as, iron, cobalt, nickel, steel, rare-earth metal alloys, ceramic magnets, nickel-iron alloys, rare-earth magnets (e.g., a Neodymium magnet, a Samarium-cobalt magnet), other known materials such as Co-netic AA®, Mumetal®, Hipernon®, Hy-Mu-80®, Permalloy® which all may comprise about 80% nickel, about 15% iron, with the balance being copper, molybdenum, chromium, any other suitable material as would be appreciated by one of ordinary skill in the art upon viewing this disclosure, or any combination thereof. For example, in an embodiment, the magnetic valve 216 may comprise a magnet, for example, a ceramic magnet or a rare-earth magnet (e.g., a neodymium magnet or a samarium-cobalt magnet). In such an embodiment, the magnetic valve 216 may comprise a surface having a magnetic north-pole polarity and a surface having magnetic south-pole polarity and may be configured to generate a magnetic field, for example, a magnetic field with a sufficient attraction force to couple the magnetic valve 216 to a surface (e.g., outer chamber surface 221*a* and/or the inner chamber surface 221*b*) of the housing 210 of the MVA 200, as will be disclosed herein. In the embodiments of FIGS. 3A-3B, 4A-4B, 5A-5B, 6A-6B, 7A-7B, and 8A-8B, the magnetic valve 216 may be disposed within the housing 210 (e.g., within the ported chamber 220) of the MVA 200.

In an embodiment, the magnetic valve 216 may be movable from a first position to a second position with respect to the housing 210. In an embodiment, the magnetic valve 216 may be configured to allow or disallow a route of fluid communication between the flow passage 36 of the MVA 200 and the exterior 250 of the MVA 200, for example, a route of fluid communication via the outer port 212*a* and the inner port 212*b*, based on the position of the magnetic valve 216 with respect to the housing 210, one or more ports 212 (e.g., the inner port 212*b*, the outer port 212*a*, etc.), and/or ported chamber 220, as will be disclosed herein.

Figure 5A:
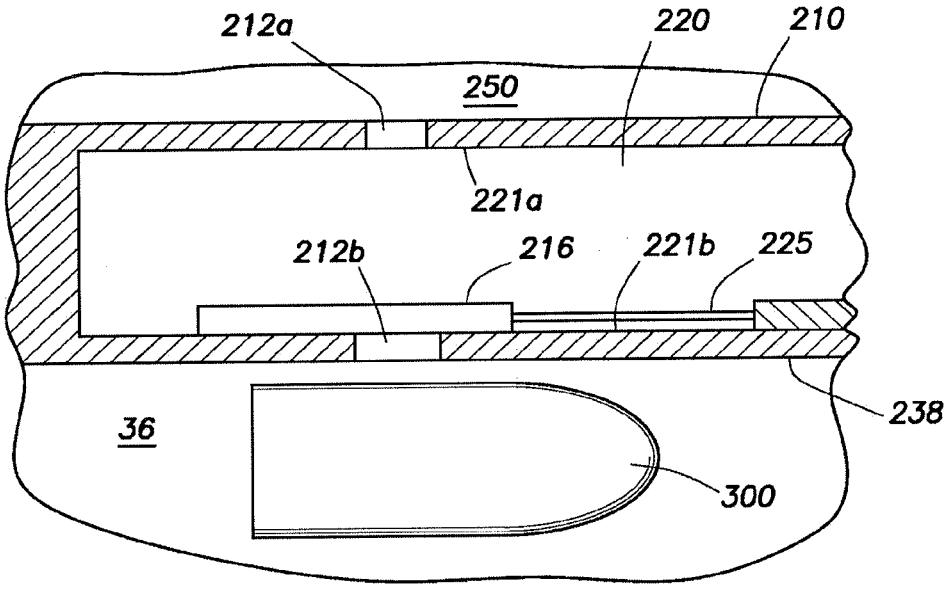
FIG. 5A is a cross-sectional view of an embodiment of a magnetic valve assembly comprising a bistable switch in a first position.
Figure 6A:
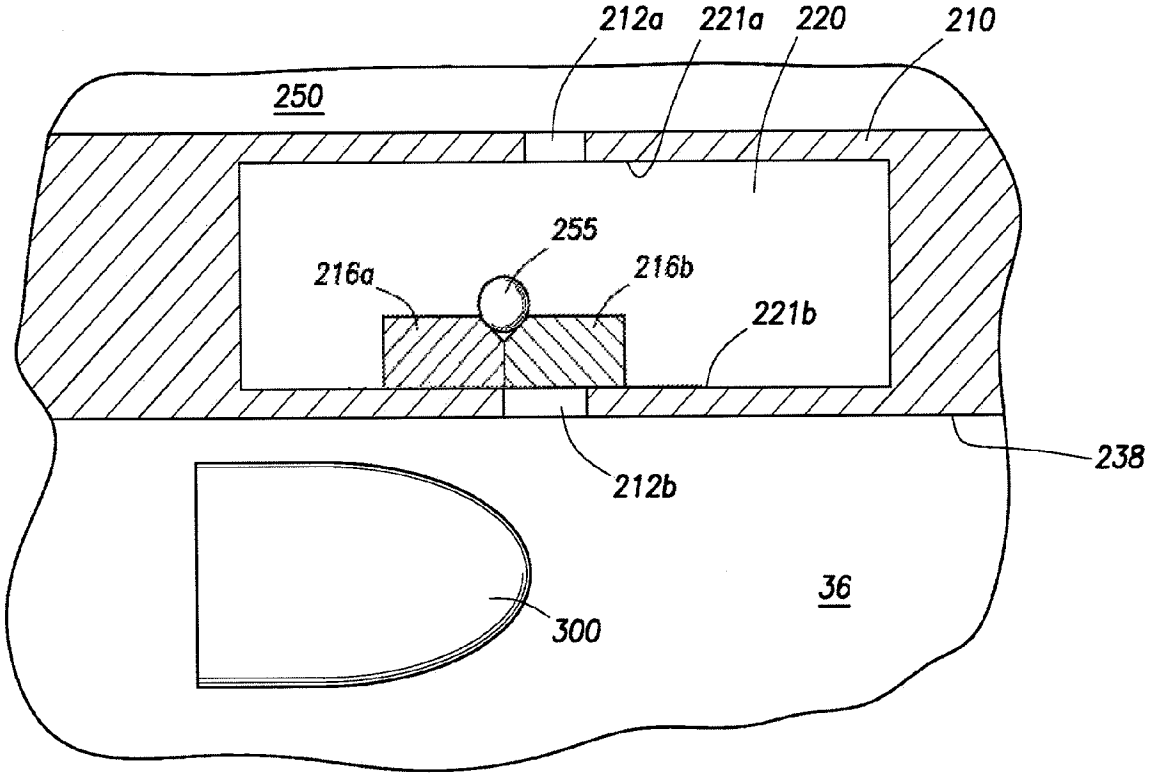
FIG. 6A is a cross-sectional view of an embodiment of a magnetic valve assembly comprising a sliding segment in a first position.
Figure 7A:
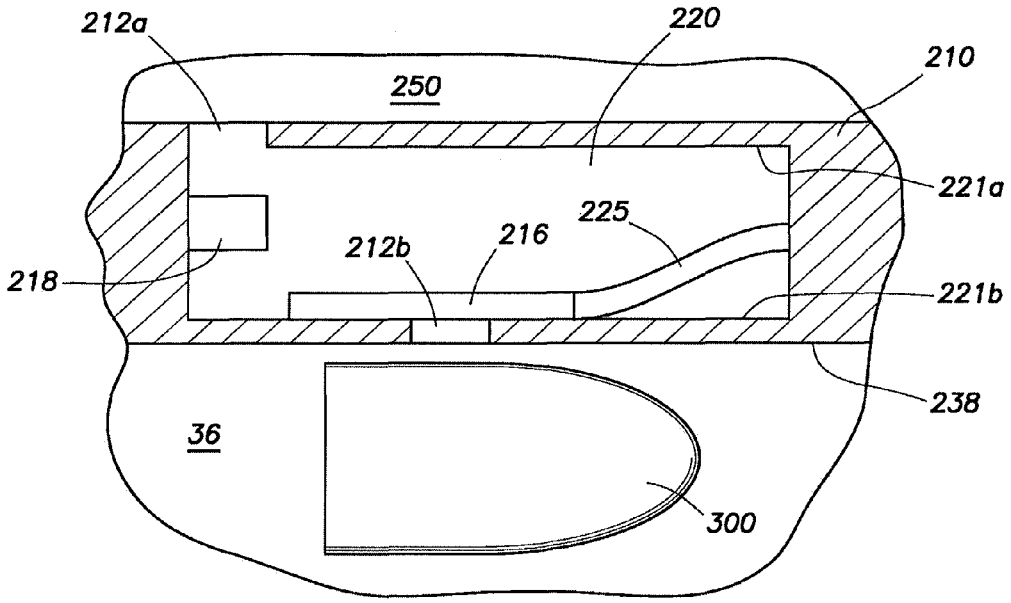
FIG. 7A is a cross-sectional view of an embodiment of a magnetic valve assembly comprising a bistable switch and a biasing member in a first position.
Figure 8A:
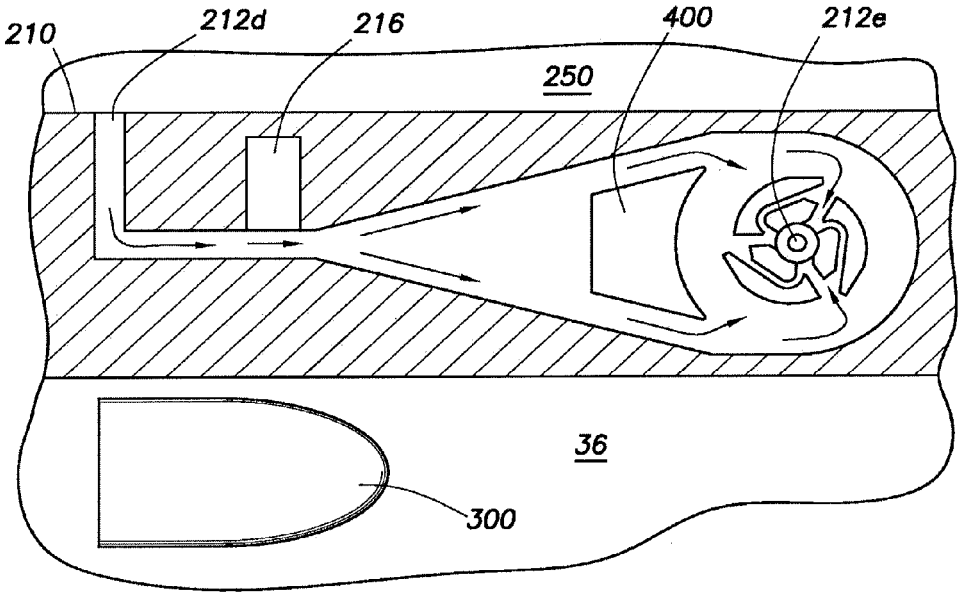
FIG. 8A is a cross-sectional view of an embodiment of a magnetic valve assembly comprising a flow control device and a diverter in a first position.

Referring to the embodiments of FIGS. 3A, 4A, 5A, 6A, 7A, and 8A, the magnetic valve 216 is illustrated in the first position. In the embodiments illustrated in FIGS. 3A, 6A, and 7A, the magnetic valve 216 engages the inner port 212*b* of the housing 210, and thereby prohibits or substantially restricts fluid communication from the exterior 250 of the MVA 200 to the flow passage 36 of the MVA 200 via the ports 212 (e.g., the inner port 212*b*). Additionally, in an embodiment, then the magnetic valve 216 engages the inner port 212*b* of the housing 210, the magnetic valve 216 may prohibit or substantially restrict fluid communication from the flow passage 36 to the exterior 250 of the MVA 200. In the embodiment of FIG. 6A, where the magnetic valve 216 comprises the sliding segment 216*b*, in the first position at least a portion of the magnetic valve 216 (e.g., the sliding segment 216*b*) may be positioned to block at least a portion of the inner port 212*b* and thereby blocks a route of route of fluid communication between the ports 212. Additionally, in an embodiment where the MVA 200 comprises a check valve ball 255, when the sliding segment 216*b* is in the first position the MVA 200 may be configured such that check valve ball 255 is retained, for example, within the ported chamber 220. In the embodiments of FIGS. 4A and 5A, when the magnetic valve 216 is in the first position, the magnetic valve 216 blocks a first flow path (e.g., via the inner port 212*b* as illustrated in FIG. 5A or the bypass port 212*c* as illustrated in FIG. 4A) and does not block a second flow path (e.g., via the outer port 212*a* as illustrated in FIG. 5A or the inner port 212*b* as illustrated in FIG. 4A), thereby allowing fluid communication via the second flow path. In an embodiment, when the magnetic valve 216 is in the first position, the MVA 200 may be in the first configuration. In the embodiment of FIG. 8A, the when the magnetic valve

216 is in the first position, the magnetic valve 216 directs fluid flow along an upper flow path into the vortex chamber, which may have a different resistance to flow between an exterior port 212*d* and an interior port 212*e* than the lower flow path.

Figure 5B:
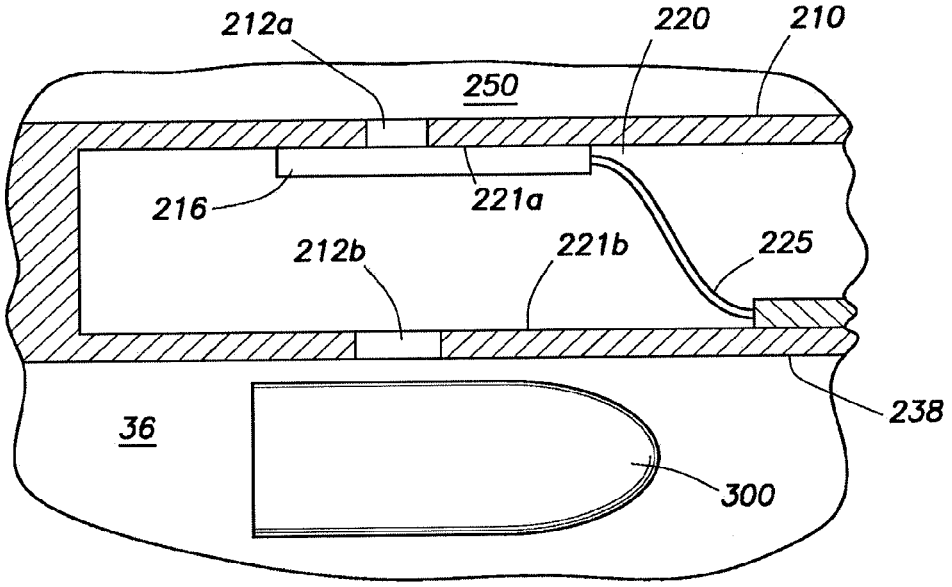
FIG. 5B is a cross-sectional view of an embodiment of a magnetic valve assembly comprising a bistable switch in a second position.
Figure 6B:
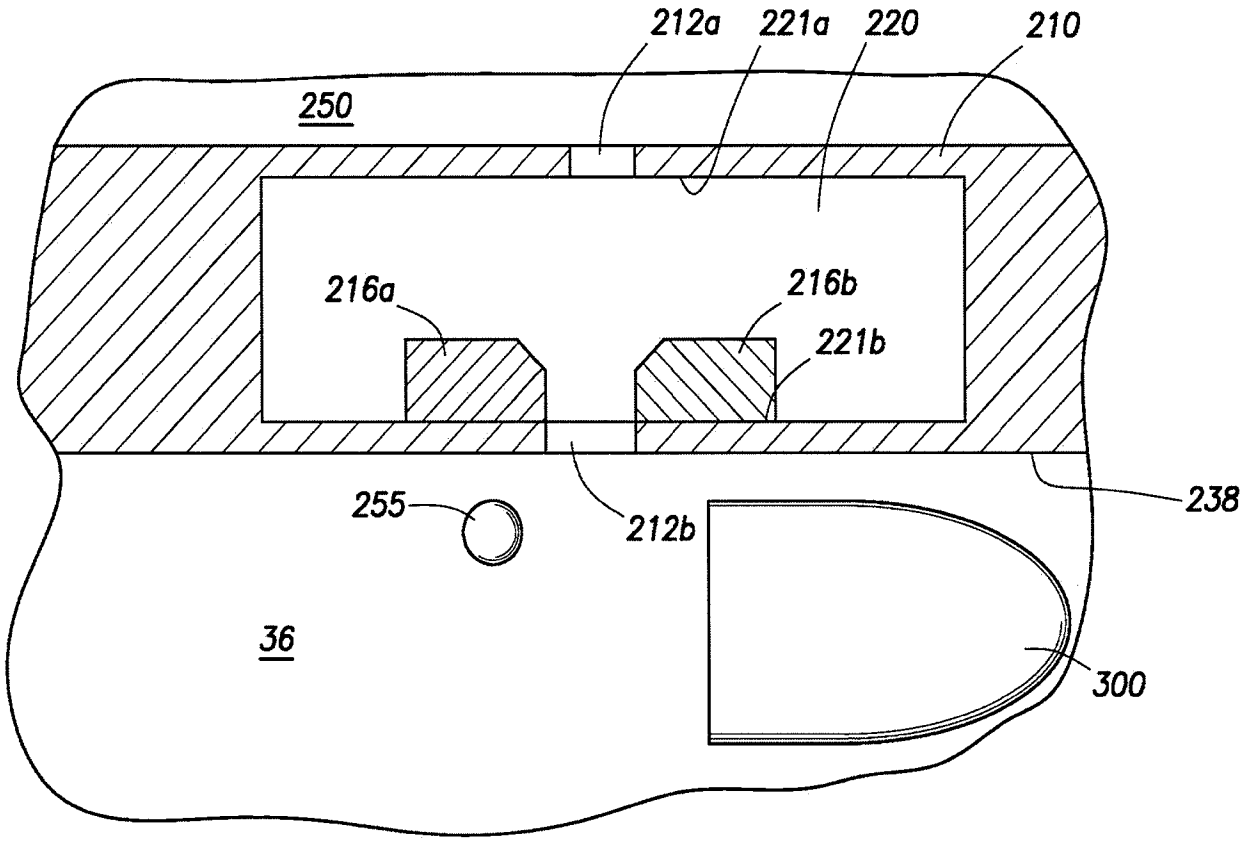
FIG. 6B is a cross-sectional view of an embodiment of a magnetic valve assembly comprising a sliding segment in a second position.
Figure 7B:
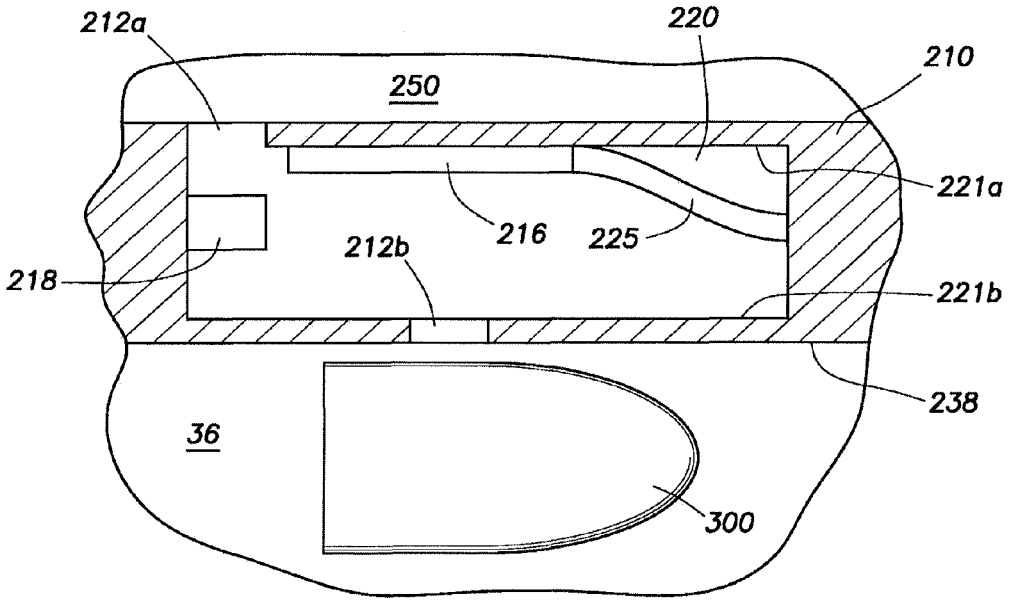
FIG. 7B is a cross-sectional view of an embodiment of a magnetic valve assembly comprising a bistable switch and a biasing member in a second position.
Figure 8B:
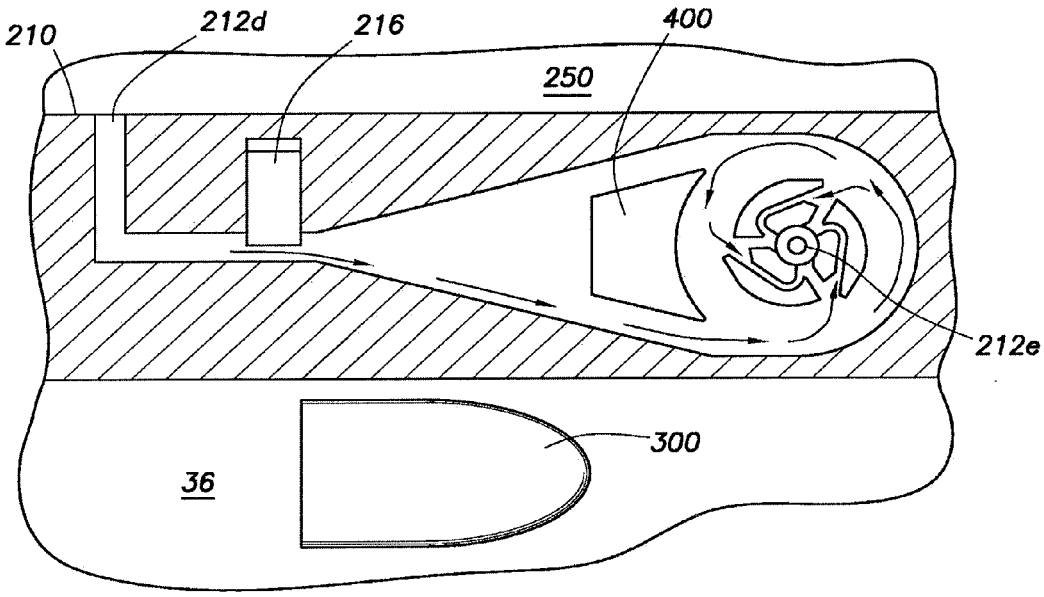
FIG. 8B is a cross-sectional view of an embodiment of a magnetic valve assembly comprising a flow control device and a diverter in a second position.

Referring to the embodiments of FIGS. 3B, 4B, 5B, 6B, 7B, and 8B, the magnetic valve 216 is illustrated in the second position. In the embodiments illustrated in FIGS. 3B, 6B, and 7B, the magnetic valve 216 does not block the inner port 212*b* of the housing 210 and thereby, allows a route of fluid communication between the flow passage 36 of the housing 210 and the exterior 250 of the MVA 200 via the ports 212 (e.g., the inner port 212*b* and the outer port 212*a*). In the embodiment of FIG. 6B, where the magnetic valve 216 comprises the sliding segment 216*b*, the inner port 121*b* may not be blocked by the magnetic valve 216 (e.g., the sliding segment 216*b*) and thereby allows a route of fluid communication between the ports 212. Additionally, in an embodiment where the MVA 200 comprises a check valve ball 255, when the sliding segment 216*b* is in the second position the MVA 200 may be configured to release the check valve ball 255, for example, from the ported chamber 220 into the flow passage 36. In an alternative embodiment as illustrated in FIGS. 4B and 5B, when the magnetic valve 216 is in the second position, the magnetic valve 216 does not block the first flow path (e.g., via the inner port 212*b* as illustrated in FIG. 5B or the bypass port 212*c* as illustrated in FIG. 4B), thereby allowing fluid communication via the first flow path. Additionally, in the embodiments of FIGS. 4B and 5B in the second position, the magnetic valve 216 blocks the second flow path (e.g., via the outer port 212*a* as illustrated in FIG. 5B or the inner port 212*b* as illustrated in FIG. 4B). In an embodiment, when the magnetic valve 216 is in the second position, the MVA 200 may be in the second configuration. In the embodiment of FIG. 8B, the when the magnetic valve 216 is in the second position, the magnetic valve 216 allows a route of fluid communication along the lower flow path between an exterior port 212*d* and an interior port 212*e*.

In an embodiment, the magnetic valve 216 may be held (e.g., selectively retained) in the first position or the second position by a suitable retaining mechanism. For example, in an embodiment, the magnetic valve 216 may be held (e.g., selectively retained) in the first position or the second position by a magnetic coupling between the magnetic valve 216 and the housing 210 of the MVA 200. Not intending to be bound by theory, where the magnetic valve 216 comprises a surface having a magnetic north-pole polarity and a surface having magnetic south-pole polarity and may be configured to couple with a surface of the housing 210 via a magnetic attractive force between magnetic fields of dissimilar polarities, for example, a magnetic north-pole surface of the magnetic valve 216 coupled to a magnetic south-pole surface of the housing 210. Additionally, in an embodiment as illustrated in FIGS. 7A-7B, the magnetic valve 216 may be maintained in the first position or the second position by a biasing member 218 (e.g., a permanent magnet) disposed within the housing 210 (e.g., the ported chamber 220). In such an embodiment, the magnetic valve 216 and the biasing member 218 may be repelled from one another via a magnetic repulsive force between magnetic fields of similar polarities, for example, a magnetic north-pole surface of the magnetic valve 216 repelled from a magnetic north-pole surface of the housing 210. Additionally, in the embodiments of FIGS. 6A-6B, the magnetic valve 216 (e.g., the sliding segment 216*b*) may be frictionally fit to one or more surfaces of the ported chamber 220 (e.g., the inner chamber surface 221*b*) to limit the axial translation of magnetic valve 216. In an additional or alternative embodiment, the magnetic valve 216 may be retained in the first position or the second position via a guiding arm, as will be disclosed herein.

In an embodiment, the magnetic valve 216 may be configured to be selectively transitioned from the first position to the second position. In an embodiment magnetic valve 216 may be configured to transition from the first position to the second position via a magnetic repulsive force from an interaction with a magnetic field, as will be disclosed herein. For example, in an embodiment, in response to experiencing a magnetic field of a disposable magnetic member 300 via one or more ports 212 (e.g., the inner port 212*b*) and/or windows, the magnetic valve 216 may transition to the second position, as will be disclosed herein. In such an embodiment, the magnetic valve 216 and the disposable magnetic member 300 may be repelled from one another via a magnetic repulsive force between magnetic fields of similar polarities, for example, a magnetic south-pole surface of the magnetic valve 216 repelled from a magnetic south-pole surface of the disposable magnetic member 300.

Additionally, in an embodiment as illustrated in FIGS. 3A-3B, 4A-4B, 5A-5B, and 7A-7B, the magnetic valve 216 may be coupled to a guiding arm 225 and tethered to one or more surfaces of the housing 210 via the guiding arm 225. In an embodiment, the guiding arm 225 may be configured to control and/or at least partially restrict the movement of the magnetic valve 216. For example, in an embodiment, the guiding arm 225 may be configured to guide the magnetic valve 216 from the first position to the second position and may prevent and/or reduce trajectory deviations as the magnetic valve 216 transitions from the first position to the second position. In an embodiment, the guiding arm 225 may comprise partially or substantially flexible material (e.g., an elastomer, metal, composite, etc.), partially or substantially rigid materials (e.g., a plastic, metal, composite, etc.), any other suitable material as would be appreciated by one of ordinary skill in the arts upon viewing this disclosure, or combinations thereof. For example, a guiding arm 225 may be a flexure, a spring, a cable, a rod, a hinge, any other suitable material as would be appreciated by one of ordinary skill in the arts upon viewing this disclosure, or combinations thereof.

Additionally, in an embodiment, the guiding arm 225 may be configured to bias the magnetic valve 216 in the direction of the first or second position. For example, in an embodiment, the guiding arm 225 may be configured to apply a force in the direction of the first position onto the magnetic valve 216 and may be configured to transition (e.g., to return) the magnetic valve 216 to the first position from the second position, for example, following a reduction in differential pressure applied to the MVA 200 and/or the magnetic valve 216. In an alternative embodiment, the guiding arm 225 may be configured to apply a force in the direction of the second position onto the magnetic valve 216 and may be capable of retaining the magnetic valve 216 in the second position upon transitioning to the second position.

Additionally, in an embodiment as illustrated in FIGS. 8A-8B, the MVA 200 may comprise an actuator or a diverter 400. In such an embodiment, the diverter 400 can be pivotable, rotatable, and/or otherwise movable in response to a signal from the disposable magnetic member 300. For example, in an embodiment, the diverter 400 is operable to control a fluid flow ratio through the MVA 200 (e.g., via the ports 212). In such an embodiment, the diverter 400 may be magnetic (e.g., comprise one or more ferromagnetic portions) and may be configured to be operated via a magnetic force (e.g., a magnetic force generated by a disposable magnetic member). Suitable types and/or configuration of actuators and diverters 400 are described in U.S. Patent Publication No.

2012/0255739 entitled "Selectively Variable Flow Restrictor for Use in a Subterranean Well" to Fripp et al, the entire disclosure of which is incorporated herein by reference for all purposes. Suitable flow control devices including autonomous inflow control devices with which an actuator or diverter can be used may include those described in U.S. Patent Publication No. 2012/0211243 entitled "Method and Apparatus for Autonomous Downhole Fluid Selection with Pathway Dependent Resistance System" to Dykstra et al. and U.S. Patent Publication No. 2011/0266001 entitled "Method and Apparatus for Controlling Fluid Flow Using Movable Flow Diverter Assembly" to Dykstra et al., the entire disclosures of which are incorporated herein by reference.

In an embodiment, a disposable magnetic member 300 may be configured to generate a magnetic field, for example, the magnetic field may be formed by or contained within a tool, or other apparatus (e.g., a ball, a dart, a bullet, a plug, etc.) disposed within the wellbore 114, within the wellbore tubular string 120. For example, in the embodiments of FIGS. 3A-3B, 4A-4B, 5A-5B, 6A-6B, and 7A-7B, the disposable magnetic member 300 (e.g., a dart) may be configured to be disposed within the flow passage 121 of the wellbore tubular string 120 and/or the flow passage 36 of the MVA 200 and to radiate a magnetic field so as to allow the magnetic field to interact with the MVA 200 and/or the magnetic valve 216, as will be disclosed herein. In an alternative embodiment, the disposable magnetic member 300 may comprise an electromagnet, as will be disclosed herein. While described as a disposable member, the disposable magnetic member 300 can be considered to be disposable even if it is retrieved back to the surface (e.g., removed from the wellbore).

In an embodiment, the disposable magnetic member 300 may be made of a ferromagnetic material (e.g., a material susceptible to a magnetic field), such as, iron, cobalt, nickel, steel, rare-earth metal alloys, ceramic magnets, nickel-iron alloys, rare-earth magnets (e.g., a Neodymium magnet, a Samarium-cobalt magnet), other known materials such as Co-netic AA®, Mumetal®, Hipernon®, Hy-Mu-80®, Permalloy® which all may comprise about 80% nickel, 15% iron, with the balance being copper, molybdenum, chromium, and/or any other suitable material as would be appreciated by one of ordinary skill in the art upon viewing this disclosure, or any combination thereof. For example, in an embodiment, the disposable magnetic member 300 may comprise a magnet, for example, a ceramic magnet or a rare-earth magnet (e.g., a neodymium magnet or a samarium-cobalt magnet). In such an embodiment, the disposable magnetic member 300 may comprise a surface having a magnetic north-pole polarity and a surface having magnetic south-pole polarity and may be configured to generate a magnetic field, for example, for the purposes of repelling and/or attracting one or more magnetic valves 216.

In an alternative embodiment, the disposable magnetic member 300 may comprise an electromagnet comprising an electronic circuit comprising a current source (e.g., current from one or more batteries, a wire line, etc.), an insulated electrical coil (e.g., an insulated copper wire with a plurality of turns arranged side-by-side), a ferromagnetic core (e.g., an iron rod), and/or any other suitable electrical or magnetic components as would be appreciated by one of ordinary skill in the arts upon viewing this disclosure, or combinations thereof. In such an embodiment, the electromagnet may be configured to provide an adjustable magnetic polarity and may be configured to engage one or more MVAs and/or to not engage one or more other MVAs. In an embodiment, the disposable magnetic member 300 may comprise an insulated electrical coil electrically connected to a current source, thereby forming an electromagnet. Additionally, in such an embodiment, a metal core may be disposed within the electrical coil, thereby increasing the magnetic flux (e.g., magnetic field) of the electromagnet. Not intending to be bound by theory, according to Ampere's Circuital Law, the insulated electric coil may produce a temporary magnetic field while an electric current flows through it and may stop emitting the magnetic field when the current stops. Applying a direct current (DC) to the electric coil may form a magnetic field of constant polarity and reversing the direction of the current flow may reverse the magnetic polarity of the magnetic field.

One or more embodiments of a MVA 200 and a system comprising one or more of such MVA 200 having been disclosed, one or more embodiments of an actuation method utilizing the one or more MVAs 200 (and/or system comprising such MVA 200) is disclosed herein. In an embodiment, such a method may generally comprise the steps of providing a wellbore tubular string 120 comprising one or more MVAs 200 within a wellbore 114, optionally, isolating adjacent zones of the subterranean formation 102, passing a disposable magnetic member 300 within the flow passage 36 of the MVA 200, preparing the MVA 200 for communication of a formation fluid (for example, a hydrocarbon, such as oil and/or gas), and communicating a formation fluid via the ports 212 of the MVA 200. In an additional embodiment, for example, where multiple MVA 200 are placed within a wellbore 114, an actuation method may further comprise repeating the process of preparing the MVA 200 (e.g., toggling one or more MVAs) for the communication of a production fluid and communicating a production fluid via the MVAs 200.

Referring to FIG. 2, in an embodiment the actuation method comprises positioning or "running in" a wellbore tubular string 120 comprising a plurality of MVA 200*a*-200*i* within the wellbore 114. For example, in the embodiment of FIG. 2, the wellbore tubular string 120 has incorporated therein a first MVA 200*a*, a second MVA 200*b*, a third MVA 200*c*, a fourth MVA 200*d*, a fifth MVA 200*e*, a sixth MVA 200*f*, a seventh MVA 200*g*, an eighth MVA 200*h*, and a ninth MVA 200*i*. Also in the embodiment of FIG. 2, the wellbore tubular string 120 is positioned within the wellbore 114 such that the first MVA 200*a*, the second MVA 200*b*, the third MVA 200*c*, the fourth MVA 200*d*, the fifth MVA 200*e*, the sixth MVA 200*f*, the seventh MVA 200*g*, the eighth MVA 200*h*, and the ninth MVA 200*i* may be positioned proximate and/or substantially adjacent to a first, a second, a third, a fourth, a fifth, a sixth, a seventh, an eighth, and a ninth subterranean formation zone 2, 4, 6, 8, 10, 12, 14, 16, and 18, respectively. It is noted that although in the embodiment of FIG. 2, the wellbore tubular string 120 comprises nine MVAs (e.g., MVA 200*a*-200*i*), one of ordinary skill in the art, upon viewing this disclosure, will appreciate that any suitable number of MVA 200 may be similarly incorporated within a tubular string such as the wellbore tubular string 120, for example one, two, three, four, five, six, seven, eight, or more MVA 200. In an alternative embodiment, two or more MVA 200 may be positioned proximate and/or substantially adjacent to a single formation zone, alternatively, a MVA 200 may be positioned adjacent to two or more zones.

As disclosed herein, in the embodiments where the MVA 200 is in the first configuration, the magnetic valve 216 is held in the first position, thereby prohibiting or substantially restricting fluid communication in the direction from the exterior 250 of the MVA 200 to the flow passage 36 of the MVA 200 via the inner port 212*b*. In an additional embodiment, when the magnetic valve 216 is in the first position, the magnetic valve 216 may be configured to prohibit or substantially restrict fluid communication in the direction from the flow passage 36 of the MVA 200 to the exterior 250 of the MVA 200. In the embodiments of FIGS. 4A and 5A, where the MVA 200 is in the first configuration, the magnetic valve 216 is held in the first position, thereby prohibiting or substantially restricting a second flow path from the exterior 250 of the MVA 200 to the flow passage 36 of the MVA 200 via the bypass port 212*c*. In an additional embodiment, when the magnetic valve 216 is in the first position, the magnetic valve 216 may be configured to prohibit or substantially restrict fluid communication the direction from the flow passage 36 to the exterior 250 of the MVA 200 via the bypass port 212*c*.

In an embodiment, for example, as shown in FIG. 2, the MVA 200*a*-200*i* may be integrated within the wellbore tubular string 120, for example, such that, the MVA 200 and the wellbore tubular string 120 comprise a common flow passage. Thus, a fluid and/or an object introduced into the wellbore tubular string 120 will be communicated with the MVA 200. In the embodiment, the MVA 200 is introduced and/or positioned within a wellbore 114 in the first configuration and/or the second configuration.

In an embodiment, once the wellbore tubular string 120 comprising the MVA 200 (e.g., MVA 200*a*-200*i*) has been positioned within the wellbore 114, one or more of the adjacent zones may be isolated and/or the wellbore tubular string 120 may be secured within the formation 102. For example, in the embodiment of FIG. 2, the first zone 2 may be isolated from relatively more up-hole portions of the wellbore 114 (e.g., via a first packer 170*a*), the first zone 2 may be isolated from the second zone 4 (e.g., via a second packer 170*b*), the second zone 4 from the third zone 6 (e.g., via a third packer 170*c*), the third zone 6 from the fourth zone 4 (e.g., via a fourth packer 170*d*), the fourth zone 8 from relatively more downhole portions of the wellbore 114 (e.g., via a fifth packer 170*e*), or combinations thereof. In an embodiment, the adjacent zones may be separated by one or more suitable wellbore isolation devices. Suitable wellbore isolation devices are generally known to those of skill in the art and include but are not limited to packers, such as mechanical packers and swellable packers (e.g., Swellpackers™, commercially available from Halliburton Energy Services, Inc.), sand plugs, sealant compositions such as cement, or combinations thereof. In an alternative embodiment, only a portion of the zones (e.g., zones 2-18) may be isolated, alternatively, the zones may remain unisolated. Additionally and/or alternatively, in an embodiment, a casing string may be secured within the formation, as noted above, for example, by cementing.

In an embodiment, following positioning one or more MVAs and/or securing the wellbore tubular string 120, the wellbore servicing system comprising one or more MVAs (e.g., MVA 200*a*-200*i*) configured in the first position and/or the second position may remain in such a configuration for any desired amount of time (e.g., weeks, months, years, etc.).

In an embodiment where the wellbore is serviced working from the furthest-downhole formation zone progressively upward, once the wellbore tubular string 120 has been positioned and, optionally, once adjacent zones have been isolated, the first MVA 200*a* may be prepared for the communication of a formation fluid (for example, a hydrocarbon, such as oil and/or gas) from the proximate formation zone(s). In an embodiment, preparing the MVA 200 to communicate the formation fluid may generally comprise communicating a magnetic field (e.g., via a disposable magnetic member 300) within the flow passage 36 of the MVA 200 to transition the MVA 200 from the first configuration to the second configuration.

In an embodiment, a magnetic field may be communicated to one or more MVAs 200 to transition the one or more MVAs 200 from the first configuration to the second configuration and/or from the second configuration to the first configuration, for example, by transitioning the magnetic valve 216 from the first position to the second position or from the second position to the first position. In an embodiment, the disposable magnetic member 300 field may be conveyed (e.g., from the surface by a pump tool) to the flow passage 36 of the MVA 200, for example, by introducing the disposable magnetic member 300 (e.g., a dart) to the wellbore tubular string 120. In an embodiment, the magnetic field may be unique (e.g., have a predetermined magnetic polarization) to one or more MVAs 200. For example, a MVA 200 may be configured such that a predetermined magnetic polarization may elicit a given response from that particular well tool. For example, the magnetic field may be characterized as being unique to a particular tool (e.g., one or more of the MVA 200*a*-200*i*).

In an embodiment, in response to experiencing the magnetic field of the disposable magnetic member 300, the one or more magnetic valves 216 may move from the first position to the second position or from the second position to the first position. For example, one or more magnetic valves 216 may move from the first position to the second position as a result of a repulsive force from an interaction of similar polarities between the magnetic field of the one or more magnetic valves 216 and the disposable magnetic member 300. In an embodiment, upon transitioning from the first position to the second position, the magnetic valve 216 may be retained in the second position. For example, the magnetic valve 216 may be retained in the second position via a magnetic attractive force of dissimilar polarities (e.g., a north pole and a south pole) between the magnetic fields of the one or more magnetic valve 216 and the magnetic field of the outer chamber surface 221*a*. In an alternative embodiment where the magnetic valve 216 comprises the sliding segment 216*b*, as illustrated in FIGS. 6A-6B, as the disposable magnetic member 300 passes through the flow passage 36 of the MVA 200 the sliding segment 216*b* may move or slide along a surface (e.g., the inner chamber surface 221*b*) of housing 210 in the direction of the second position by a repulsive force from an interaction of similar polarities (e.g., a north pole and a north pole, a south pole and a south pole) between the magnetic field of the sliding segment 216*b* and the disposable magnetic member 300. Additionally, in an embodiment where the MVA 200 comprises the check valve ball 255, the check valve ball 255 may be released into the flow passage 36 of the MVA 200, for example, from the ported chamber 220 via the inner port 212*b*.

In an embodiment, as shown in FIGS. 3B, 6B, and 7B, the transition of the one or more magnetic valve 216 from the first position to the second position unblocks the inner port 212*b*, thereby providing a route of fluid communication between the inner port 212*b* and the outer port 212*a*, thereby allowing fluid communication between the exterior 250 of the MVA 200 and the flow passage 36 of the MVA 200. Additionally, in the embodiment where the MVA 200 comprises a check valve ball 255, the check valve ball 255 may be released into the flow passage 36 of the MVA 200, for example, from the ported chamber 220 via the inner port 212*b*, as illustrated in FIGS. 3A-3B. In an alternative embodiment, as shown in FIGS. 4B and 5B, the transition of the magnetic valve 216 from the first position to the second position unblocks a second flow path, for example, a flow path via the bypass port 212*c* as shown in FIG. 4B, thereby providing an alternative route of fluid communication between the exterior 250 of the MVA 200 and flow passage 36 of the MVA 200. Additionally or alternatively, in such an embodiment, the first flow path may be blocked by the magnetic valve 216 and/or the guiding arm 225, if present, when the magnetic valve 216 is in the second position. In an additional or alternative embodiment, one or more of the MVAs 200 may transition from the second position to the first position, as previously disclosed.

In an embodiment, once the wellbore servicing system has been configured for the communication of a formation fluid (e.g., a hydrocarbon, such as oil and/or gas, an aqueous fluid, etc.), for example, when one or more MVAs 200 have transitioned to the second configuration, as disclosed herein, the fluid may be communicated to/from the formation (e.g., first formation zone 2), for example, via the unblocked ports 212 of the MVAs 200. For example, in the embodiment of FIG. 2, the first MVA 200*a* may transition from the first configuration to the second configuration and may communicate a fluid between the first MVA 200*a* and the first formation zone 2.

In an embodiment, the process of preparing the MVA 200 for the communication of a fluid (e.g., a production fluid) via communication of an experienced magnetic field, and communicating a production fluid via one or more MVAs 200 may be repeated with respect to one or more of the well tools (e.g., the first MVA 200*a*, the second MVA 200*b*, the third MVA 200*c*, the fourth MVA 200*d*, the fifth MVA 200*e*, the sixth MVA 200*f*, the seventh MVA 200*g*, the eighth MVA 200*h*, and/or the ninth MVA 200*i*). In an additional or alternative embodiment, one or more of the MVAs 200 may selectively alternate between the second configuration and the first configuration, or vice-versa. For example, referring to FIG. 2, the process of preparing the MVA may be repeated for the first MVA 200*a* and may close the one or more ports 212. In an additional or alternative embodiment, one or more MVAs 200 (e.g., the second MVA 200*b*) may be prepared for communication of a fluid (e.g., a production fluid).

One of ordinary skill in the art, upon viewing this disclosure, will appreciate that a wellbore servicing system (like the wellbore servicing system) comprising one or more MVAs 200 may be comprise any suitable number of and/or combinations of MVA configurations and may be configured to selectively transition and/or toggle one or more of the MVAs 200.

It should be understood that the various embodiments previously described may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. Accordingly, the foregoing detailed description is to be clearly understood as being given by way of illustration and example only, the spirit and scope of the invention being limited solely by the appended claims and their equivalents.

While embodiments of the invention have been shown and described, modifications thereof can be made by one skilled in the art without departing from the spirit and teachings of the invention. The embodiments described herein are exemplary only, and are not intended to be limiting. Many variations and modifications of the invention disclosed herein are possible and are within the scope of the invention. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k*(Ru−Rl), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present invention. Thus, the claims are a further description and are an addition to the embodiments of the present invention. The discussion of a reference in the Detailed Description of the Embodiments is not an admission that it is prior art to the present invention, especially any reference that may have a publication date after the priority date of this application. The disclosures of all patents, patent applications, and publications cited herein are hereby incorporated by reference, to the extent that they provide exemplary, procedural or other details supplementary to those set forth herein.

What is claimed is:

1. An actuation system for a downhole component comprising:

a wellbore tubular comprising a central flowbore and a magnetic valve seat, wherein the magnetic valve seat is disposed about the wellbore tubular;

a disposable member comprising at least one magnet, wherein the disposable member is configured to be received within the central flowbore; and a ball, wherein the at least one magnet is configured to axially shift the magnetic valve seat from a first position to a second position when the disposable member passes within the central flowbore, wherein the ball is configured to sealingly engage the magnetic valve seat, wherein the magnetic valve seat is configured to retain and engage the ball when the magnetic valve seat is in the first position, and wherein the magnetic valve seat is configured to release the ball into the central flowbore when the magnetic valve seat is in the second position.

2. The actuation system of claim 1, further comprising a flow path disposed between an exterior of the wellbore tubular and the central flowbore, wherein the magnetic valve seat is configured to block flow through the flow path in the first position, and wherein the magnetic valve seat is configured to allow flow through the flow path in the second position.

3. The actuation system of claim 2, further comprising at least one of an autonomous inflow control device or an inflow control device in the flow path.

4. The actuation system of claim 1, wherein the magnetic valve seat and the ball are configured to act as a check valve.

5. The actuation system of claim 1, further comprising an inflow control device disposed in a flow path between an exterior of the wellbore tubular and the central flowbore via one or more ports, wherein when the magnetic valve seat is in the first position, the magnetic valve seat prevents a route of fluid communication through the inflow control device, and when the magnetic valve seat is in the second position, the magnetic valve seat allows fluid communication through the inflow control device.

6. A method of actuating a magnetic valve in a wellbore comprising:

preventing, by a magnetic valve component disposed about a wellbore tubular, fluid flow through a fluid pathway in a wellbore assembly in a first direction, wherein the fluid pathway is configured to provide fluid communication between an exterior of the wellbore assembly and a central flowbore of the wellbore assembly, and wherein at least one magnetic valve component comprises a magnetic seat configured to engage a ball;

passing a magnetic member through the central flowbore of the wellbore assembly; wherein the disposable member comprises a magnetic field;

transitioning at least one magnetic valve component from a first position to a second position in response to the magnetic field of the magnetic member, wherein transitioning the at least one magnetic valve component comprises axially shifting the magnetic seat to release the ball;

allowing fluid flow through the fluid pathway in the first direction in response to the transitioning of the at least one magnetic valve component.

7. The method of claim 6, wherein the wellbore assembly comprises an autonomous inflow control device, and wherein transitioning the at least one magnetic valve component comprises shifting the at least one magnetic valve component from a closed position to a restricted position.

8. The method of claim 6, wherein the at least one magnetic valve component prevents fluid communication between the exterior of the wellbore assembly and the central flowbore of the wellbore assembly when the at least one magnetic valve component is in the first position.

9. The method of claim 6, further comprising releasing a ball in response to the transitioning of the at least one magnetic valve, wherein the ball is configured to prevent fluid flow through the fluid pathway in the wellbore assembly in a second direction when the at least one magnetic valve component is in the first position.

10. The method of claim 6, wherein the at least one magnetic valve component prevents fluid communication in a second direction through the fluid pathway when the at least one magnetic valve component is in the second position.

* * * * *